US005115566A

United States Patent [19]

Zeitlin

[11] Patent Number: 5,115,566

[45] Date of Patent: May 26, 1992

[54] FOOD AND LIQUID FANNING DEVICE

[76] Inventor: Eric Zeitlin, 3059 Grand Ave., Baldwin, N.Y. 11510

[21] Appl. No.: 486,812

[22] Filed: Mar. 1, 1990

[51] Int. Cl.[5] ..... B25F 3/00

[52] U.S. Cl. ..... 30/142; 30/324; 417/411

[58] Field of Search ..... 30/142, 149, 150; 126/25 B; 417/411, 423.2, 423.7, 423.15, 313; 99/476, 517; 248/231.8, 231.5

[56] References Cited

U.S. PATENT DOCUMENTS

| | | | |
|---|---|---|---|
| 1,026,904 | 5/1912 | Burke | 417/423.7 |
| 1,464,731 | 8/1923 | Smith | 248/231.8 |
| 2,687,843 | 8/1954 | Alcock | 417/64 |
| 2,766,928 | 10/1956 | Jendrassik | 417/64 |
| 3,259,132 | 7/1966 | Katter | 30/141 |
| 3,647,323 | 4/1972 | Thomas | 417/234 |
| 4,044,750 | 8/1977 | Zeigler | 126/25 B |
| 4,190,034 | 2/1980 | Wonisch | 126/25 B |
| 4,529,360 | 7/1985 | Kirchhofer et al. | 417/64 |
| 4,605,190 | 8/1986 | Kamp | 248/231.8 |
| 4,734,017 | 3/1988 | Levin | 417/411 |
| 4,799,639 | 1/1989 | Riley | 248/231.5 |
| 4,799,858 | 1/1989 | Shin-Chin | 248/231.5 |
| 4,810,173 | 3/1989 | Thomson et al. | 417/411 |
| 4,914,819 | 3/1990 | Ash | 30/141 |

*Primary Examiner*—Richard A. Bertsch
*Assistant Examiner*—Michael I. Kocharov

[57] ABSTRACT

An electrically actuated food and liquid fanning device (Z) that may be removably secured to a food or liquid holding utensil (F), container, or the like, which will generate a draft in a desired direction that is of material assistance in cooling the food or liquid held by the utensil (F), container, or other food or liquid holding device.

12 Claims, 3 Drawing Sheets

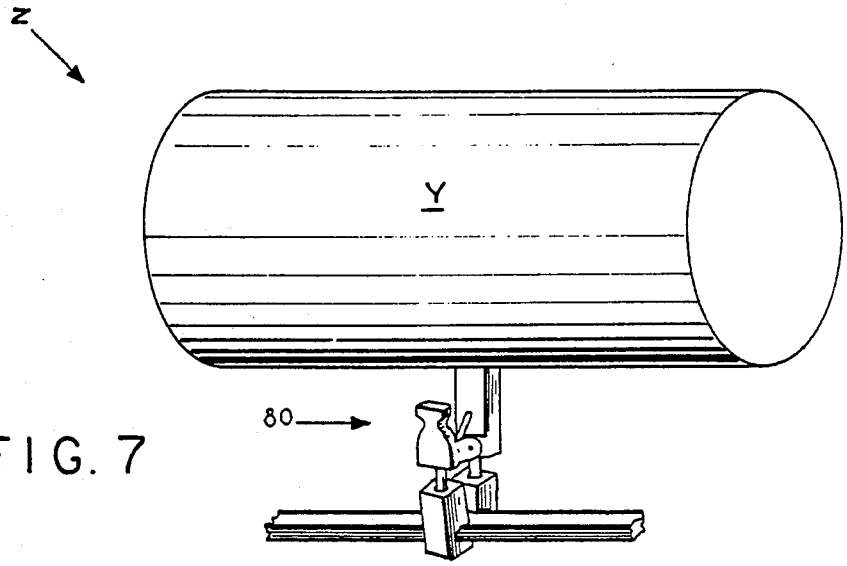
FIG. 7
FIG.7A
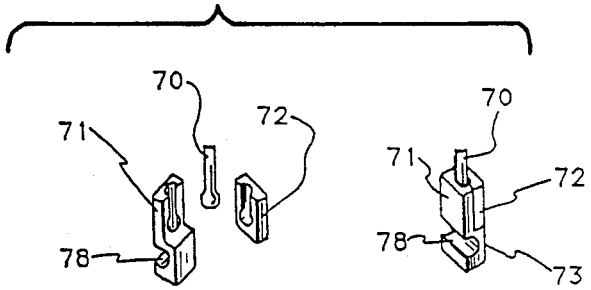
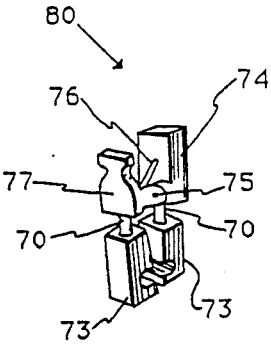
FIG.7B
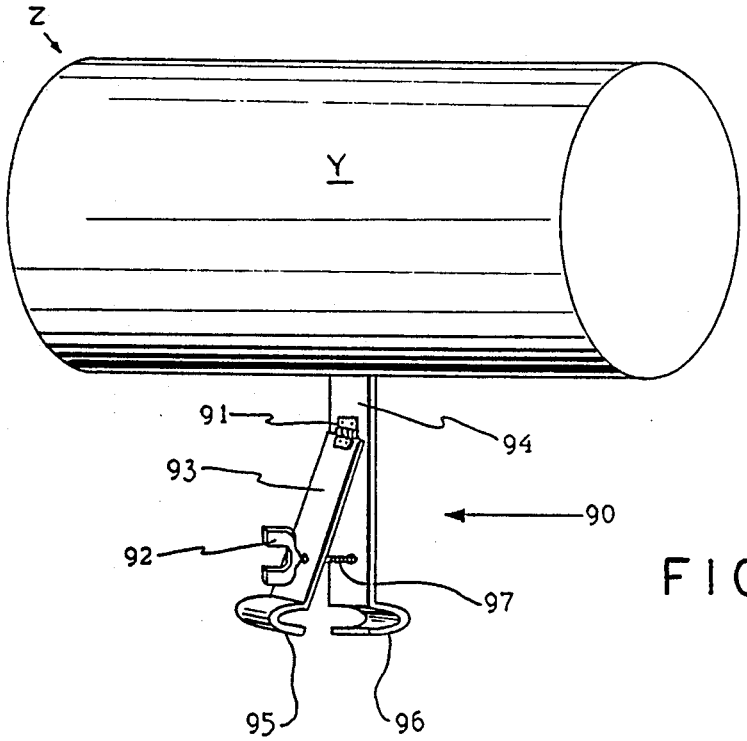
FIG.8

FOOD AND LIQUID FANNING DEVICE

BACKGROUND—FIELD OF INVENTION

This invention relates to fanning devices, more specifically to a device used to fan foods and liquids.

BACKGROUND—DESCRIPTION OF PRIOR ART

Heretofore, there has been no quick, easy, efficient and interesting way to cool hot foods or liquids conveniently while, for example, sitting at the dinner table after the food or liquid (i.e.; soup, coffee) has already been prepared and served.

Until now efforts to cool food or liquid that is too hot for the eater to eat has been limited to either putting ice in/on the hot food or liquid, blowing breath on the hot food or liquid by the eater, or just waiting until the hot food or liquid fools down sufficiently to enable comfortable ingestion.

These methods have many disadvantages which the present invention avoids:

1—Putting ice on/in the hot food or liquid causes food to get "soggy" and liquid to get "watered down".

2—Just waiting is time consuming and frustrating if the eater is either impatient, hungry, or in rush, such frustration possibly leading to bad moods, strained relationships, fits of anger or high blood pressure and its related symptoms (i.e.; strokes or heart attacks).

3—Blowing breath on the hot food or liquid by the eater, probably the most common method used by eaters, contains such disadvantages as:

a—the stream of breath is intermittent due to the limited capacity of human lungs.

b—the stream of breath is not always accurate, sometimes missing the hot food or liquid although, thus providing an inefficient means of cooling and a less-than-optimal method of cooling given the amount of breath blown.

c—the eater may suffer adverse health effects from blowing his breath, such as dizziness, nausea, or feinting resulting from hyperventilation or hypoventilation.

d—because of reasons (a) and (b) discussed above, cooling of hot food or liquid takes longer than perhaps the eater wants to wait before ingesting his meal, leading to frustration and its ill-effects discussed above.

e—if the eaters breath is either misdirected or too forceful, the hot food or liquid being blown on can easily by blown off/out of its holding device (i.e.; fork, spoon, bowl, cup, etc.) which can result in wasted food and liquids, leading to a further decreased world food supply and resulting starvation of the poorer peoples on earth as well as the decreased economic well being of the eater due to his own increased food costs. Furthermore, hot food or liquid that is blown off/out of its holder can be dangerous, leading to possible injuries such as scalding, burning, or injuries resulting from the fear of getting burned or scalded such as jumping incorrectly from ones chair or pulling a muscle from quick, jerky movements resulting from trying to withdraw ones body from the direction of the moving/flying hot food or liquid which has been blown off/out of its holder.

4—Present cutlery and other food and liquid holding devices are non-novel, increasing boredom while eating, resulting in a possibly less-than-exciting eating experience, and possible overeating by the eater due to the eater being bored.

The prior art contains many fanning devices, but none of these are made specifically for the fanning of food and liquids as the present invention is, nor do any of these prior art patents make any reference to their being used to that extent. Further, none of the prior art patents are designed for the same ease of use or towards simple, one-handed use as the present invention is. Additionally, none of the prior art patents contain the resilient "on" and "off" switch of the present invention which adds to ease of use.

Two examples of such fanning devices are Thomas' "Battery Operated Fanning Device", U.S. Pat. No. 3,647,323 and Zeigler's "Barbecue Blower" U.S. Pat. No. 4,044,750, both of which are designed to fan a fire or charcoal. Neither make any mention of being used to fan food or liquid nor do either mention that they may be modified to do so, showing that the present invention and its uses were unobvious to those skilled in the art. The present invention further distinguishes itself from these examples of the closest prior art in many other ways; for example, the resilient "on" and "off" switch of the present invention is easier to use than the on and off switches of the prior art in that it allows one-handed, even one fingered (the thumb) operation, whereas the prior art's switches are more complicated to switch on and off, and if used in the context or situation of the present invention would be likely to cause spillage or droppage of the food or liquid being held by the cutler or similar holding device, as well as create a difficulty of use that might deter a potential user.

The present invention also provides better accuracy than the prior art, allowing the "aiming" of the stream of air exiting the device. Although Ziegler's device allows some aiming due to the ability of his device to tilt on it's attaching mechanism, the present invention would allow up and down, side to side, and all angle movement of the front of the device and hence the "aiming" of the resulting stream of air. In addition, because the present invention allows flexibility closer to where the air is exiting, a greater accuracy can be expected than for example, from Zeigler's device, which only allows flexibility at its base.

Further, the present invention is less obtrusive, because of its compact cylindrical shape, than the prior art, and thus better suited for the situation that the present invention is designed for, namely the fanning of foods and liquids.

The Inventor contends that because of these and other differences which will become obvious upon further inspection of the present invention, the present invention thus distinguishes itself in its novelty over the prior art.

OBJECTS AND ADVANTAGES

Accordingly, several objects and advantages of the present invention are:

1—to supply a compact device of simple mechanical structure, that is removably or permanently situated on a holder of food or liquids or other such similar devices, so that the unit, when activated, will blow a stream of air which can be directed onto, over, or around the food or liquid being held by the holder.

2—to provide a food and liquid fanning device which will bring more safety to the eating of hot foods and liquids by preventing such conditions as dizziness, nausea or feinting resulting from hyperventilation or hypoventilation, or other conditions resulting from unnatural breathing because of blowing breath on foods or liquids.

3—to provide a food and liquid fanning device which will add additional safety to the eating of hot foods and liquids by helping to prevent burns and scalding to the eater, caused by the ingestion of insufficiently cooled food or liquid (i.e.; a burnt tongue or throat) due to the eater using such inefficient cooling methods as described above.

4—to provide a food and liquid fanning device which will add additional safety to the eating of hot foods and liquids by helping to prevent burns and scaling to the eater due to falling hot food or liquid which may be blown off/out of its holder due to a misdirected or too forceful stream of breath, as well as pulled muscles or the like due to the same situation.

5—to provide a food and liquid fanning device which will add additional safety to the eating of hot foods and liquids by helping to eliminate some of the frustration and its resulting maladies from the eating of hot foods and liquids, as previously discussed, by providing a faster, more efficient way of cooling such hot foods or liquids than the present methods of cooling discussed above.

6—to provide a more enjoyable eating experience to an eater by preventing the burning of his taste buds from ingesting insufficiently cooled food or liquids, hence enabling the eater to taste his food or liquids fully.

7—to help protect the economic well being of an eater by helping to prevent unnecessary spillage or droppage of food or liquid due to a misdirected or too strong stream of breath, thus helping to keep his food costs as low as possible.

8—to help prevent the starvation of the poorer peoples of the earth by helping to prevent unnecessary spillage or droppage of food or liquid due to a misdirected or too strong stream of breath, thus helping to make sure no food or liquid is unnecessarily wasted.

9—to provide a food and liquid fanning device which helps reduce any additional need for cleaning tables, chairs, floors, and other surfaces of the dining area by helping to prevent unnecessary spillage or droppage of food or liquid due to a misdirected or too strong stream of breath onto any such dining area surfaces.

10—to provide a food and liquid fanning device which will provide faster means of cooling foods and liquids through its constant and more accurately directed stream of air which may be directed at or towards the food or liquid to be cooled.

11—to provide a food and liquid fanning device which is easy to use because of its ability to be easily used with only one hand and at the simple push of a button.

12—to provide a more interesting food and liquid fanning device which will bring novelty to present food and liquid cooling methods. The present invention, especially if colored, painted, or otherwise made to be further pleasing to the eye, will help eliminate boredom of the user while eating, and thus will help extinguish boredom related symptoms such as overeating, feelings of depression, or fighting with ones dining companions.

13—to provide a food and liquid fanning device which will further help the user's human relationships by letting him talk with his dining companions if he so desires instead of having to use his breath to blow on his food or liquid.

14—to provide a food and liquid fanning device which will even further help the user's human relationships by helping to eliminate any potentially embarrassing situations to the user such as food or liquid being blown off/out of its holder as previously discussed and onto the user or the users dining companions.

15—to provide a food and liquid fanning device which will provide a more reliable cooling means than the current methods, as long as the present invention's power supply is charged, since, for example, ice may melt or an eater may be out of breath, coughing, sneezing, or otherwise unable to blow breath on his food or liquid.

16—to provide a food and liquid fanning device which will provide a means of cooling food and liquids that is ecologically safe to the earth's atmosphere; contrasted to an eater simply blowing breath on his food or liquids, where the eater, since he is exhaling more than when he is not blowing breath onto his food or liquid, is thus putting more carbon dioxide, a major atmospheric pollutant which is contributing to global warming and the "greenhouse effect", into the atmosphere than if he was using the present invention, which emits no more carbon dioxide than is already in the atmosphere.

17—to provide a food and liquid fanning device of greater accuracy and precision of cooling means than present cooling methods by providing an "on" and "off" button that can be instantly turned on or off by the user, as well as a constant stream of precisely directed air onto, over or around the food or liquid being cooled.

18—to provide a food and liquid fanning device which will be easily saleable because of its small size, ease of use, and universal need for such a drive, as well as easy market penetration because of the nonexistence of similar devices in the present marketplace.

19—to provide a food and liquid fanning device which will provide excitement to both neophiles and laypersons alike through the present inventions newness and novelty.

20—to provide a food and liquid fanning device which will have a long product life cycle, since there will be a need for the present invention as long as there is a need to cool foods and liquids.

21—to provide a food and liquid fanning device which will help save energy by precluding the need to reheat foods or liquids that have overcooled because of the inaccuracy of present cooling methods (i.e.: waiting too long for food or liquid to cool).

22—to provide a food and liquid fanning device which will not have to be modified depending on the "handedness" of the user; the food and liquid fanning device will work just as well for a user who is left-handed as one who is right-handed without having to modify the device.

23—to provide a food and liquid fanning device which will be smaller than those in the prior art and less obtrusive, thus suiting the present invention to being attached to a food or liquid holding device, such as a spoon, without the present invention causing substantial weight to be added onto the spoon being held and also not causing inconvenience to the user because of any obtrusiveness of the device. These benefits of the present invention that are void in the prior art are due to such features as an air intake in the middle of the present invention and not in the back (as in Zeigler's device) and the prime mover and power supply being located inside the housing as opposed to adjacent to and sticking out from the housing (as in Zeigler's and Thomas' devices).

24—to provide a food and liquid fanning device which will be more stable when placed on a food or liquid holding device (i.e.; a spoon) by the inclusion of a stabilizer on the Food and Liquid Fanning Device.

Still further objects and advantages will become apparent from a consideration of the ensuing description and drawings.

DRAWING FIGURES

FIGS. 7, 7A and 7B show perspective views of a possible ramification of the Food and Liquid Fanning Device, showing the makeup of a clamp-on device for the Food and Liquid Fanning Device.

FIG. 8 shows a perspective view of another possible ramification of the Food and Liquid Fanning Device, showing the makeup of a screw clamp device for the Food and Liquid Fanning Device.

REFERENCE NUMERALS IN DRAWINGS

Figure 1:
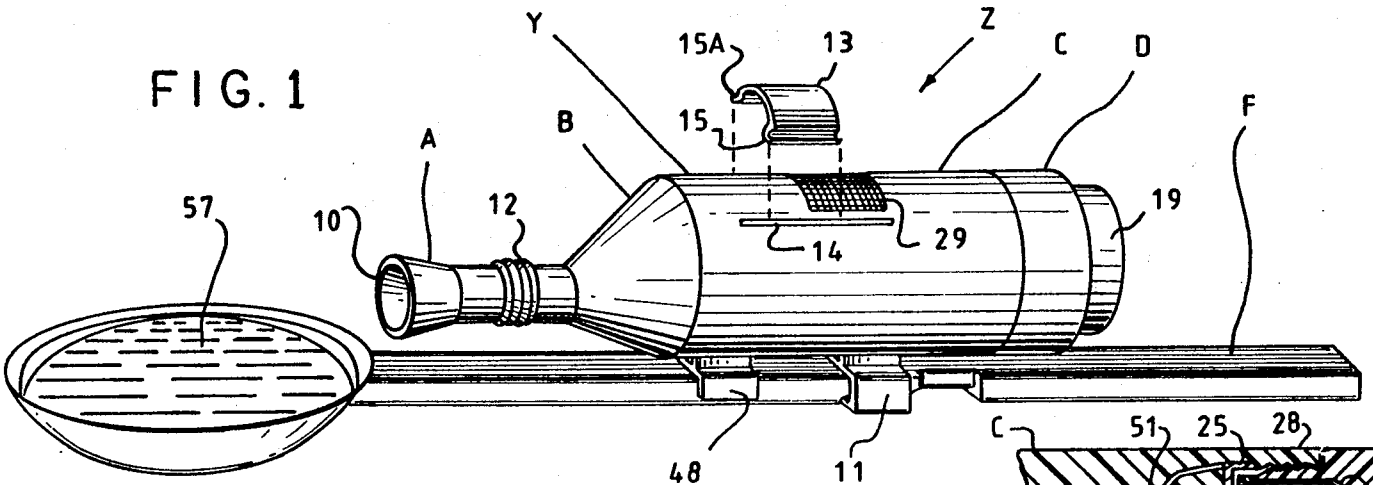
FIG. 1 is a perspective view of a Food and Liquid Fanning Device (Z) attached to a spoon (F), with air-intake cover (13) not yet attached.

A—forwardly disposed housing part
B—first intermediate housing part
C—second intermediate housing part
D—back end housing part
E—longitudinal shaft assembly
F—cutlery; here a spoon
Y—entire housing of the Food and Liquid Fanning Device
Z—The entire Food and Liquid Fanning Device
10—opening at front of housing part (A)
11—clip-on attaching unit
12—flexible connecting material between housing parts (A) and (B)
13—air-intake cover
14 and **14*a***—longitudinal notches in housing (Y)
15 and **15*a*—"footlike" extensions of air-intake cover (13) that fit into 14 and 14*a*** respectively
16—elongate shaft
17—electric motor
18—battery
19—"on" and "off" switch
20—column of electrically conductive material on switch (19)
21—electrically conductive insulated wire
22—wall in housing part (D)
23, **23*a*, 23*b*, 23*c***—commercially available springs
24—ring of electrically conductive material on tongue (27)
25—ring of electrically conductive material on inside of housing part (C)
26—electrically conductive insulated wire
27—tongue of housing part (D)
28—rearward end of housing part (C)
29—screen
30 and **30*a***—notches on spoon (F)
31—transverse spider
32—Multi-bladed circular fan
33—air-intake opening
34—air passage
35—tongue of housing part (C)
36—recess of housing part (B)
37, **37*a*, 37*b*, and 37*c*—openings for insertion if springs (23, 23*a*, 23*b*, and 23*c***), respectively
38—switch extension
39 and **39*a***—protrusions on switch (19)
40—head of elongate shaft (16)
41—spacer tube
42—spacer tube
43—hub of fan (32)
44—blades of fan (32)
45—transverse bore through hub (43)
46—terminal plate of motor (17)
47—second terminal of motor (17)
48—stabilizer
49—sloping incline on spoon (F)
50—top forward protrusion of housing part (C) which holds motor (17) in place
51—top back protrusion of housing part (C) which holds motor (17) in place
52—bottom forward protrusion of housing part (C) which holds motor (17) in place
53—bottom back protrusion of housing part (C) which holds motor (17) in place
54—circular hole in the rear wall of housing part (D) which facilitates the insertion of switch (19) into part (D)
55—bore through tongue (27) for insertion of wire (21)
56—
57—liquid held by spoon (F)

RAMIFICATION DRAWINGS—FIGS. 6-8

60—commercially available springs
61—thin extension/gas container opener
62—opening of gas container
63—wall inside housing part B
64—Column
65—gas container
70—downward-pointing pole
71—front piece of gripping unit
72—back piece of gripping unit
73—whole gripping unit (71 and 72 together)
74—base of clamping unit
75—hole for bolt
76—commercially available spring
77—movable base of clamping unit
78—where rubber, etc. may be placed
79—
80—entire clamping device
90—entire screw clamp device
91—hinge
92—fly bolt
93—moving arm 94—base/attaching arm
95—"foot" on moving arm (93)
96—"foot" on base arm (94)
97—commercially available screw

DESCRIPTION—FIGS. 1 TO 5

A typical embodiment of the Food and Liquid Fanning Device (Z), as illustrated in the drawings, includes an elongate housing (y) formed by housing parts (A,B,C,D) that has at least one first open end (10) and at least one second opening which serves as an air intake (33), which openings are connected by an internal longitudinal passage (34).

Figure 2:
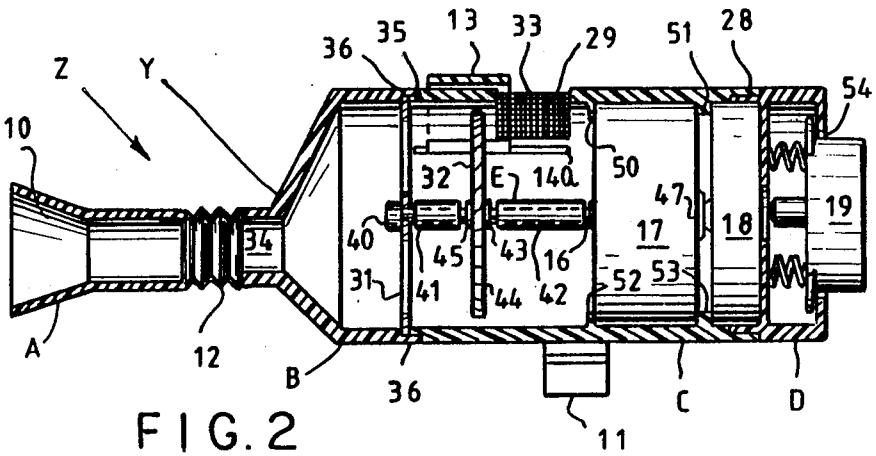
FIG. 2 is a cross sectional side view of the Food and Liquid Fanning Device (Z) shown in FIG. 1; spring (23*b*) not shown in this figure in order to facilitate clarity of the drawing.

FIG. 2 shows the housing (Y) having a transverse spider (31) located intermediate housing parts (B and C) therein. A longitudinal shaft assembly (E) is disposed in the passage (34), with one end of the shaft assembly being supported by the spider (31) and the opposite end being carried by the electrically operated motor (17) which drives the shaft when activated. A multi-bladed circular fan (32) is provided that is rotatably supported on the shaft (E). the air intake (33) may have a screen (29) covering it or being attached underneath the air intake to the inside wall of the housing (Y) with suitable attaching means such as glue, adhesive, or the like.

FIG. 2 shows an adjustable sliding air intake cover (13) attached to housing part (C) through the insertion of the foot-like extensions (15 and 15*a*) of the cover (13) into the thin longitudinal notches (14 and 14*a*) respectively located on part (C), with cover (13) being slidable, after insertion to housing part (C), over the air intake (33). Thus the cover (13) serves to restrict the effective area of the air intake (33) in allowing air to flow from the ambient atmosphere into the passage (34) as the multibladed fan (32) draws air into the passage (34) after being driven by actuation of the electrically operated motor (17). FIG. 1 shows the air-intake cover (13) before attachment to housing (Y).

The housing (Y) is preferably molded from a suitable polymerized resin, although any sturdy, lightweight material would be appropriate. Housing (Y) may be formed either as a whole integral unit or from multiple parts as shown here in the preferred embodiment.

FIG. 2 shows the forward section of the housing, part (B), having at its second end a recess (36) defined therein. Housing part (C) is also shown to have at its first end a tongue (35) which extends and engages the recess (36) of housing part (B). Housing parts (B) and (C) may be permanently secured to each other by conventional means such as glue, adhesive, or the like. The spider (31) is removably held in place within the confines of housing (y) by having peripheral edge portions thereof engaged by circumferentially extending surfaces (35) and (36).

The shaft assembly (E), as may be seen in FIG. 2, includes an elongate shaft (16) that has a head (40) on the forward end thereof, and the shaft having the forward end portion rotatably mounted in a centrally disposed transverse opening defined in the spider (31). The shaft (16) on the forward portions thereof, has two spacer tubes (41,42) mounted thereon with the forward end of spacer tube (41) loosely abutting against the spider (31) and the rearward end of spacer tube (41) loosely abutting against the forward face of a hub (43) that forms a part of the fan (32), and from which hub a number of circumferentially spaced blades (44) project to draw air inwardly through air intake (33) and expel it through outlet opening (10) whenever motor (17) is actuated. The hub (43) has a transverse bore (45) extending therethrough. The bore (45) rotatably supports the fan (32) on the shaft (16). The forward end of spacer tube (42) is loosely abutted against the backward face of the hub (43) and the rearward end of spacer tube (42) is loosely abutted against the forward face of the electrically operated motor (17).

Figure 5:
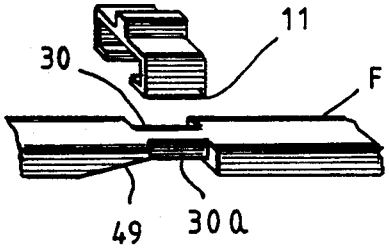
FIG. 5 shows a fragmentary perspective view of the clip-on attaching unit (11 and spoon (F) before attachment of the former to the latter, showing in detail the means of attachment.

FIG. 1 shows how the housing (Y) may be removably supported on a food or liquid holding utensil, shown in the preferred embodiment as a specially designed spoon (F). A means for securing housing (Y) to spoon (F) is shown as a downwardly-extending clip-on unit (11) which may be designed as part of housing (Y) or developed separately and secured to housing (Y) by conventional securing means. Housing (Y) may be secured temporarily (or permanently if desired) to spoon (F) by inserting the clip-on unit (11) into the notches (30 and 30*a*) located on spoon (F) and subsequently pushing the housing (Y) and clip-on unit (11) forward along upwardly sloping incline (49) on spoon (F), thus creating a tight "grip" between the clip-on unit (11) and spoon (F), as shown in FIG. 5. Food and Liquid Fanning Device (Z) is thus held in place on spoon (F). Other conventional attaching means, such as clamps, glues, adhesives, magnets, and the like may also be used to secure housing (Y) to spoon (F), but a non-permanent attaching means is preferred so that cleaning of the utensil or container is easily facilitated once the Food and Liquid Fanning Device (Z) is removed from it. Additionally, other food or liquid holding devices may be used in place of spoon (F), such as forks, knives, other serving utensils, cups, mugs, bowls, glasses, and the like.

FIGS. 1 and 2 sow the housing (Y) containing a forwardly disposed portion (A) which has at its front end at least one opening (10) and which is connected at its back end to the frontal portion of housing part (B) with a flexible material (12) such as rubber, thin, flexible, folded plastic (such as the kind used in common flexible plastic drinking straws), or the like, which will allow the frontal portion (A) to be moved directionally and hold itself in that position, thus providing a draft in the desired direction.

FIG. 2 shows housing (Y) containing an electric motor (17) which is held in place by forward and back protrusions (50, 51, 52 and 53) of housing part (C) and may be further secured within housing (Y) by glue, adhesive, or other conventional securing means in order to help prevent motor (17) from moving within the housing (y) or rotating therebetween. The motor (17) includes at least one electrically conductive insulated wire (26) attached thereto at a terminal plate (46) located on the backward face of motor (17) by soldering or the like. The opposite end of wire (26) is attached to and in continuous electrical contact with a thin ring of electrically conductive material (250 which is secured to and circumvents the back end of the inside wall of housing part (C) right before the threads on its rearward end (28) on housing part (C). This is more clearly shown in FIG. 3.

Figure 3:
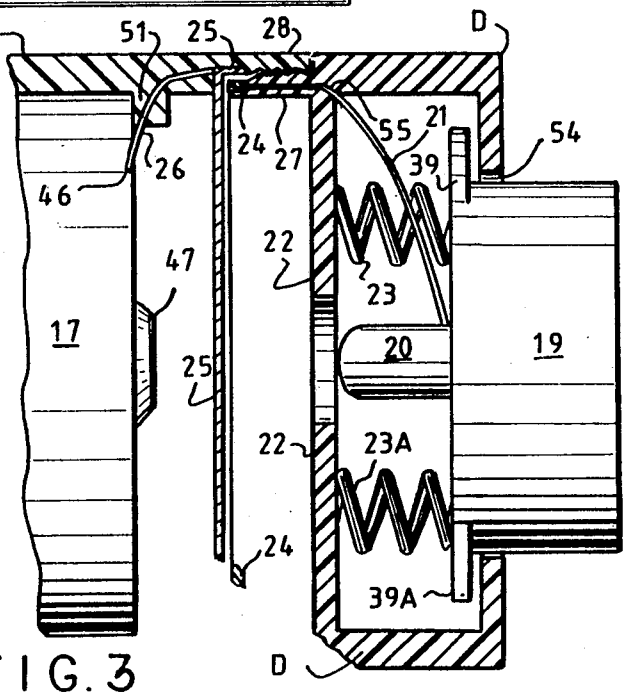
FIG. 3 is a fragmentary view of the top of FIG. 2, without battery (18) inserted therein, given in order to show that part of the Food and Liquid Fanning Device (Z) in more detail.

FIGS. 2 and 3 show how the back end housing part (D) is designed to hold a removable and replaceable battery (18) in place inside housing parts (C) and (D) so that the central terminal of battery (18) is in fixed electrical contact with the second terminal (47) of the motor (17). The battery (18) is held in place and in engagement with the aforementioned second terminal by having its backward face being in pressured contact with wall (22)

protruding from housing part (D). Note that FIG. 2 shows battery (18) inserted in housing (Y), whereas FIG. 3 shows housing (Y) without a battery (18) inserted therein.

FIGS. 2 and 3 show housing part (D) enclosing the front end of a horizontally movable "on" and "off" switch (19) which extends through a circular opening (54) in the back wall of housing part (D) and which is held in the "off" position by commercially available springs (23, 23*a*, 23*b*, and 23*c*) that are connected to switch (19) by insertion into openings (37, 37*a*, 37*b*, and 37*c*), respectively, on switch (19). Protrusions (39 and 39*a*) located on switch (19) prevent the switch (19) from being pushed beyond housing part (D) by said springs. Other resilient material may be used in place of said springs, such as rubber, plastics, or the like. Springs (23, 23*a*, 23*b*, and 23*c*) are abutted on their opposite ends against the backward face of wall (22).

FIGS. 2 and 3 illustrate how a battery (18) may be installed or removed from housing (Y) through an opening in the rear of housing part (C). To this extent the inner wall of housing part (C) is provided with threads at its rearward end (28) that cooperate with the external threads on tongue (27) of housing part (D). When housing part (D) is inserted and "screwed into" housing part (C) [i.e.: part D is inserted into part C and rotated manually until a snug it is achieved; or, similarly, upon the full cooperation of the internal and external threads] the conductive ring (25) on the inside of housing part (C) comes into physical contact and forms an electrically conductive contact with a similar ring of electrically conductive material (24) located on the outside front of tongue (27) of housing part (D).

Figure 4:
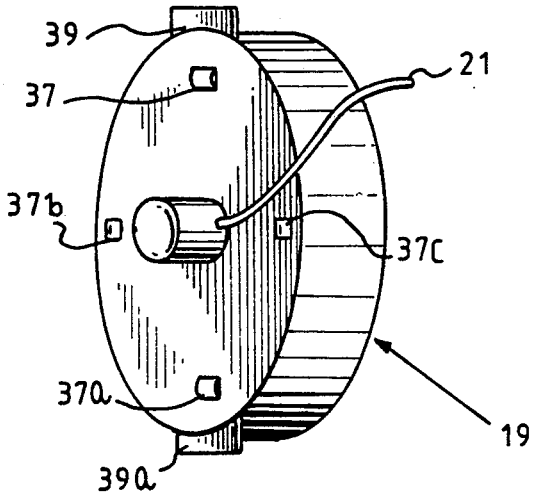
FIG. 4 is a perspective view of the "on" and "off" switch (19) shown in greater detail, without any springs attached thereto.

FIGS. 2, 3, and 4 indicate the location of a column of electrically conductive material [lie i.e.: must types of solid metals could be used for such a column] (20) extending horizontally forward from the center of the forward face of switch (19) and held in place on switch (20) by glue, adhesive, a commercially available screw, or other conventional securing means. Attached to column (20) by soldering or the like is at least one electrically conductive insulated wire (21), said wire at its other end, after passing through a bore (55) in the tongue (27), being connected, by soldering or the like, and in continuous electrical contact with the aforementioned ring of electrically conductive material (24) on the outside of tongue (27) of housing part (D), as shown more clearly in FIG. 3. The tip of column (20) is generally rounded and is adapted to come into contact with the backwards face of battery (18) when switch (19) is made to move forward [i.e.: pushed forward] horizontally into the housing part (D) by the user. Hence, the movement of switch (19) horizontally inward or outward through opening (54) will cause column (20) to also move horizontally into or out of, respectively, a circular hole in the center of wall (22) of housing part (D), thus selectively energizing fan (32) through the activation of motor (17), as will be more fully discussed below. When switch (19) is moved horizontally into housing part (D), causing also column (20) to move forward through said hole in wall (22), the aforementioned tip of column (20) will be caused to come into physical contact and hence an electrically conducting contact with the backward face of battery (18). When switch (19) is released, causing it to move horizontally out of housing part (D), column (20) will also move horizontally back through the hole in wall (22) causing the physical contact and hence the electrical contact to be broken between column (20) and battery (18).

Since the central terminal of battery (18) is in constant contact with motor (17) at terminal (47), energization of the electric motor (17) and the consequent energization of fan (32) occurs upon the aforementioned physical and electrical contact of column (20) with the backwards face of battery (18). Said contact will cause electricity to flow from battery (18) through column (20), then through wire (21), the electric current continuing on through conductive material (24) and then onwards through conductive material (25), said current finally flowing through wire (26) and into motor (17) at terminal plate (46) on the motor (17), thus completing the electric circuit into motor (17) and energizing said motor and fan (32). As mentioned previously, release of switch (19) and the subsequent retraction away from battery (18) of said switch caused by the expansion of the now contracted springs (23, 23*a*, 23*b*, and 23*c*) will result in a breaking of the previously completed electric current and hence the deactivation of motor (17) and fan (32).

FIG. 1 also shows a possible ramification of the Food and Liquid Fanning Device, showing a stabilizer (48) located on the bottom of housing (Y) in front of clip-on unit (11). The purpose of the stabilizer is to prevent the Food and Liquid Fanning Device from moving when it is attached to spoon (F) or other food or liquid holding device.

Figure 6:
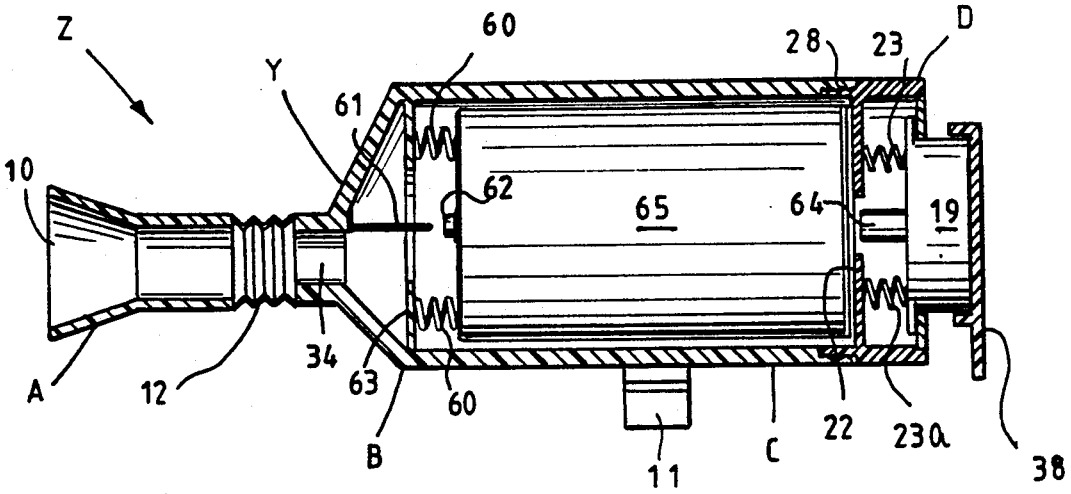
FIG. 6 is a cross sectional side view of the Food and Liquid Fanning Device (Z) shown in FIG. 1; showing a possible ramification of the Food and Liquid Fanning Device of using a container of compressed ga.

FIGS. 6–8 show further ramifications, given so as to show the versatility of the Food and Liquid Fanning Device, and some of the many forms it can take depending on the form of food or liquid holding device it is designed to be used with.

FIG. 6 shows a Food and Liquid Fanning Device which uses compressed air or other gas to provide a draft onto the food or liquid. This version of a Food and Liquid Fanning Device has similar parts to the one previously described above in FIGS. 1–5, hence only the differences will be described here. Housing (Y) is made to facilitate the insertion of a container of compressed gas (65), with opening for the release of said gas (62), which is held in place by housing part (D) after part (D) is "screwed into" housing part (C), as previously described for FIGS. 2 and 3. Housing parts (B) and (C) are made as once piece. A wall (63) similar to wall (22) is located towards the front of housing (Y), and attached to the backward face of wall (63) are a number of commercially available springs (60), in a similar manner to springs (23–23*c*). A thin, inflexible extension/gas container opener (61) is located protruding in a backward direction from the inside of housing part (B), and may be attached to housing part (B) by conventional securing means or made as part of housing part (B). Column 64 is similar to column 20 described above. A further ramification is also shown here as a switch extension (38) which can be placed over switch (19), which allows the user easier access to switch (19) and thus easier use of the Food and Liquid Fanning Device.

The Food and Liquid Fanning Device shown in FIG. 6 operates as follows: gas container (65) is inserted into housing part (C) and subsequently held in place by housing part (D). Springs (60) thus have their back ends abutting against the front of container (65), holding container (65) so that the container (65) has its back end abutted against the front face of wall (22). A draft of gas is provided when switch (19) is pushed into housing (Y)

by the user, causing column (64) to move forward through housing (Y) and come into physical contact with the back face of container (65), causing container (65) to move forward through housing (Y) and contracting springs (60) and (23–23c). This causes extension (61) to penetrate the opening (62) of container (65), whereas the previously compressed gas will be released from container (65) and forced into air-passage (34) and further out opening (10). The draft is stopped when the user releases his pressure on switch (19), whereby springs (60) and (23–23c) expand from their previously contracted position, forcing container (65) backwards through housing (Y) and extension (61) to no longer penetrate opening (62).

FIGS. 7–7B show a clamp device (80) which may be used instead of clip-on unit (11) and attached to the underside of housing (Y) in a similar manner to clip-on unit (11). Clamp device (80) is made of several parts: a downward-pointing pole (70) is embedded in the bottom of the base (74) of the clamping unit, said pole having a small ball located at the bottom of it. FIGS. 7A and 7B shows how the back piece of gripping unit (72) and front piece of gripping unit (71) fit onto each other, enclosing the lower portion of pole (70) between them and forming a whole gripping unit (73). The lower portion of the poles (70) may be covered with a lubricant to facilitate any horizontal twisting movement by the gripping units (73) around the poles (70). Said horizontal twisting movement of the gripping units (73) would be of material assistance in facilitating a good "grip" between the clamping unit (80 and the food or liquid holding device, since the gripping units (73) would be able to conform to angled surfaces as well as straight ones, both of which are found on areas such as the handles of differently designed spoons. Area (78) indicates an area where a thin layer of rubber or other material inclined to gripping or causing a better grip to be facilitated may be placed in order to facilitate a better grip between the clamping device and the food or liquid holding device (i.e.: a spoon). A movable base of the clamping unit (77) also has a whole gripping unit attached to it in the same manner as the base (74). Movable base (77) is attached to base (74) by a bolt or pin which has one end coming out of a hole in base (74) and held at hole (75) on movable base (77) and its other end coming out of and held at a similar hole on the other side of movable base (77). A commercially available spring (76) is placed between movable base (77) and base (74), as is commonly seen in large spring-loaded paper clips.

Clamp device (80) works by the user "pinching" movable base (77) and base (74) together, then positioning the facing gripping units (73) over food and liquid holding device (here a spoon [F]) and releasing their "pinch" so the two gripping units (73) grip the spoon at areas (78) as shown in FIG. 7, where the clamp device is shown attached to housing (Y) of the Food and Liquid Fanning Device. FIG. 8 shows a screw clamp (90) device attached to housing (Y) which may be used in place of and in a similar function as the clamp device (80) shows in FIGS. 78–7B. Screw clamp (90) is made of a base/attaching arm (94) which is attached to the underside of housing (Y) and has a "foot" (96) at its lower portion. A moving arm (93) is attached to base arm (94) by a commercially available hinge (91) or similar flexible material, and also has at its lower portion a "foot" (95). A commercially available screw (97) is shown with its front end coming through a hole in moving arm (93) with a "fly-bolt" (920 attached thereto, and its back end protruding through base arm (94) and held in place there by threads located in base arm (94).

The screw clamp device (90) works by the user holding the open screw clamp device (90) positioned with a food or liquid holding device (i.e.: a spoon) between "feet" (95) and (96) so that "feet" (95) and (96) will enclose the handle of said spoon when the fly-bolt (92) is turned clockwise, forcing the moving arm (93) to move towards base arm (94). Additionally, a commercially available spring may be placed between the base arm (94) and the movable arm (93), most likely so the spring encircles screw (97).

While this invention has been described with reference to a particular embodiment thereof, it is apparent that many other forms and embodiments thereof will be obvious to those skilled in the art in view of the foregoing disclosure. Thus, the scope of the invention should be determined not by the embodiments illustrated, but by the appended claims and their legal equivalents.

OPERATION OF INVENTION

The use and operation of the present invention is very simple. The invention (Z), as described in the preferred embodiment above, is first mounted on a food or liquid holding container or utensil, here a spoon (F), by means of a connecting device, here a "slip in-slide on" clip on unit. The motor (17) is actuated by the user pushing the switch (19) forward into the housing (Y), in this case through the user pushing and holding the switch (19) with their finger, most appropriately their thumb if the spoon is held in a conventional way, while holding a spoon with the Food and Liquid Fanning Device (Z) attached to it. When the user no longer desires a draft flowing onto the contents of the spoon, shown here as hot edible soup (57), they simply release any pressure that their thumb is putting on the switch (19) and let the switch (19) spring back to its original "off" position.

When the switch (19) is pushed forward, motor (17) is actuated, causing shaft (16) to rotate and hence the rotation of fan (32), which causes air to be drawn into the passage (34) through the adjustable air intake (33) and subsequently discharge out of the housing (Y) through opening (10) in housing part (A), as previously described in the Description of Invention. By moving air-intake cover (13) over air intake (33) along grooves (14 and 14a) to restrict the effective area of the latter, the volume of air discharged as a draft or stream of air onto the food or liquid held by the spoon can be easily controlled.

The direction of the discharged volume of air can be altered by manually moving the front housing part (A) into the desired position which will effectuate the directing of the discharged flow of air, as previously described.

The present invention can easily be modified and adapted to be used on a variety of utensils, containers, and other food and/or liquid holding devices, such as forks, coffee mugs, bowls, or any other conventional food or liquid holding device. The Food and Liquid Fanning Device (Z) can be used whenever and wherever the user desires a stream of air to be directed onto their food or liquid, being especially easy and convenient to use.

SUMMARY, RAMIFICATIONS, AND SCOPE

Thus, the reader will see that the present invention, the Food and Liquid Fanning Device, provides a reliable, lightweight, efficient and easy-to-use device bringing such possible benefits as safety, protected health, more enjoyable meals, excitement, cleanliness, and others previously mentioned to the environment, the user, and anyone in close proximity to the user.

While the above description contains many specificities, these should not be construed as limitations on the scope of the invention, but rather as an exemplification of one preferred embodiment thereof. Many other variations are possible, for example:

1—A motor who's speed of rotation is variable and adjustable may be used, with adjusting means enabling the user to adjust the speed of the motor manually.

2—The front opening (10) may be made adjustable in order to facilitate different types and consistencies of different foods or liquids, and similarly may be of any radius or diameter.

3—Compressed or otherwise contained air may be used instead of air from the immediate environment, with such containers of air being connected to the Food and Liquid Fanning Device sufficiently to enable the contained air to flow into the Food and Liquid Fanning Device for subsequent expulsion by the fan (32). Further, the contained air may be refrigerated or otherwise be made to be cooler than atmospheric air. Or, air need not be used at all, and instead other gases such as freon, carbon dioxide, or the like, which will most likely be contained in a container, may be used in its place.

4—Similarly, no fan need be included at all in the invention, instead relying on the compression of air or other gases which are contained in a container and the force of that compression serving to force the air or gas out in the form of a draft, said container being mounted either on, within, or separately from the housing (Y) of the Food and Liquid Fanning Device and with its opening connected into the Food and Liquid Fanning Device. A typical embodiment of this ramification would be to make the housing able to accommodate a thin container of compressed gas, with a switch on the housing and opening means upon which the activation thereof of said switch will cause the opening means to open said gas containing container. This opening of said container causing said contained gas to be released into the housing and subsequently expelled, through its own force of expulsion from said container, first into and then out of the Food and Liquid Fanning Device and onto or around the food or liquid holding utensil or the like, as well as onto or around any food or liquid said utensil may be holding.

5—The power source can be located elsewhere than inside the Food and Liquid Fanning Device, i.e.: in the utensil itself, plugged into a wall socket or converter, or the like.

6—The power source can be non-electrical, i.e.: a spring actuated motor, solar power cells, hand or finger operated, or the like.

7—The switch can be located elsewhere on the device, such as the top or side of the Food and Liquid Fanning Device, or not on the device at all and instead located on a remote control, on the cutlery, or similar place.

8—The switch can be made to have the ability to be temporarily locked in either the "on" position or the "off" position through the use of locking means.

9—The Food and Liquid Fanning Device may be attached either temporarily or permanently onto the utensil, container, etc., and may be held in place there by any conventional securing means [including means capable of directional adjustment], such as a snap-on device, magnets. slip-in device, lock-on device, tape, glue, adhesive, slide-on device, twist-on device, screw-on device, clamp, or the like. Two such examples are the clamp device and the screw clamp device, as shown in FIGS. 7-7B and 8, respectively, and described in the Description. Similarly, the clip-on device shown in FIGS. 1-5 can be made so that it will clip on to a spoon or other food or liquid holding device without said food or liquid holding device needing to be specially modified. An example of this might be a Food and Liquid Fanning Device with a clip-on device which is open on the side instead of where it is located on the clip-on device shown in FIGS. 1-5, (on the bottom).

10—The Food and Liquid Fanning Device can be made of any type of material, including metals, plastics, rubber, or any other suitable material.

11—The Food and Liquid Fanning Device can be made without an air intake cover, or may utilize other regulating means to regulate the inflow or outflow of air.

12—The Food and Liquid Fanning Device can be used with any food or liquid holding device, utensil, or container.

13—The housing of the Food and Liquid Fanning Device may be in any shape, such as rectangular, square, or the like.

14—There may be no screen used to cover the opening (33) on the top of the Food and Liquid Fanning Device, or similarly a screen or suitable mesh-like material may be used to cover the opening (10) at the front of the Food and Liquid Fanning Device.

15—The Food and Liquid Fanning Device can be made so that the battery can be inserted and used in the reverse of the position shown in the preferred embodiment in order to save space inside the Food and Liquid Fanning Device.

16—There may be more than one air-intake opening, and similarly there may be more than one front opening (10).

17—The front housing part (A) can be immovably attached to housing part (B) so that there would exist no capability for flexibility[i.e.: no flexible material at (12) ] at the connection point between parts (A) and (B).

18—The Food and Liquid Fanning Device can be made to be free standing.

19—The Food and Liquid Fanning Device can be colored in any way or similarly designed for a pleasing visual experience.

20—More than one fan can be used inside the Food and Liquid Fanning Device.

21—The switch (19) can be made hollow and "squeezable" in order to facilitate the insertion of switch (19) into housing part (D) after part (D) has been manufactured; this can then be easily done by squeezing the sides of the switch, inserting said switch into part (D), and then "unsqueezing", or letting the switch reform into it's original shape.

22—Similarly, the back wall of housing part (D) can have notches included at the outer rim of circular hole (54) in part (D) which could be the same size as protrusions (39 and **39*a*) on switch (19). Thus switch (19) can be inserted into part (D) by lining up protrusions (39 and 39*a*) at said notches and pushing a switch (19) into part (D), and then turning the switch (19**) clockwise or counterclockwise so that the protrusions are no longer lined up with said notches.

23—The air-intake cover (13) can also be designed to move over the air-intake opening (33) with an "up and down" motion (instead of the "forward to back" motion shown in the preferred embodiment), which can easily be facilitated by placing the notches (14 and 14*a*) for the air-intake cover in a vertical position on the side of and underneath the air-intake opening. Doing this would help save space lengthwise on the device. The notches (14 and 14*a*) can also be made so that part of them are on the housing where the motor is covered; in other words the notches (14 and 14*a*) would be placed further towards the back of the Food and Liquid Fanning Device than is shown in the drawings.

24—Cooling coils, refrigeration coils, or similar cooling means may be included in the inside of housing (Y), such that when air is drawn into housing (Y) and into the air passage (34), said air will come into contact with the cooling means resulting in said air becoming cooler than it was before entering housing (Y), and hence will be cooler than the atmospheric air upon discharge from housing (Y) through front opening (10).

25—A stabilizer may be attached to the housing (Y) in order to keep the Food and Liquid Fanning Device steady and unmoving when it is attached to a food or liquid holding device (as described in the description and shown in FIG. 1). The stabilizer may extend lengthwise so that the front of the stabilizer which actually rests on the handle of the spoon, fork, etc. reaches past the forward end of the spoon, fork, etc. to the back end of the bowl of the spoon, prongs of the fork, etc. In this way the stabilizer will prevent the Food and Liquid Fanning Device from moving forward on the food or liquid holding device which the Food and Liquid Fanning Device is mounted on.

26—The Food and Liquid Fanning Device's shape may be modified in relation to the food or liquid holding device it is designed to be used with; i.e.: the housing (Y) may be designed in a "V" shape in order to fit more compactly on a coffee mug.

27—The Food and Liquid Fanning Device can have a switch extension attached to switch (19), as shown in FIG. 6 as switch extension (38), in order to facilitate easier access to switch (19) by the user.

28—The Food and Liquid Fanning Device can be otherwise made so that space may be saved lengthwise, such as be designing the housing so that the battery or motor are adjacent to, above, below, etc. the rest of the Food and Liquid Fanning Device, or by designing the housing so that the battery is located adjacent to instead of in back of the motor.

Accordingly, the scope of the invention should not be solely determined by the embodiment illustrated, but by the appended claims and their legal equivalents.

I claim:

1. A combination eating utensil and fan comprising:

an eating utensil having an elongated handle portion and a food-engaging portion;

a fan means for providing a draft of air, having an elongated fan housing; and attachment means securing said fan housing to said elongated handle portion, whereby said draft is generated by said fan means onto said food-engaging portion of said eating utensil.

2. A combination eating utensil and fan as defined in claim 1, further including stabilizing means attached to said fan housing, whereby said fan housing may be held steadily on said eating utensil.

3. A combination eating utensil and fan as defined in claim 1, further including said fan housing containing a closure cap for closing a cavity adapted to receive a battery.

4. A combination eating utensil and fan as defined in claim 1 further including adjusting means for varying the open area of the air-intake of said fan housing, whereby the effective area of said air-intake may be changed.

5. A combination eating utensil and fan as defined in claim 1 wherein a flexible material is incorporated into a limited portion of the outer wall of said fan housing, whereby said draft may be directed in a more accurate direction.

6. A combination eating utensil and fan as defined in claim 1 further including said attachment means being temporary attachment means for removably attaching said fan housing to said eating utensil.

7. A combination eating utensil and fan as defined in claim 1 wherein said fan means is further comprised of:

(a) at least one multi-bladed fan disposed in said fan housing being operably connected to a prime mover;

(b) powering means, whereby power is provided to said prime mover;

(c) switch means, whereby said prime mover may be selectively actuated.

8. A combination eating utensil and fan as defined in claim 7 further including said prime mover having speed changing means which may be manually changed by a user and will result in a variance in the speed of rotation of the driveshaft of said prime mover.

9. A combination eating utensil and fan as defined in claim 7 further including said switch means being located in the center of the backwards face of said fan housing, whereby said prime mover may be selectively actuated.

10. A combination eating utensil and fan as defined in claim 7, further including said switch means being resilient.

11. A combination eating utensil and fan as defined in claim 7 further including said switch means having the ability to lock in place.

12. A combination eating utensil and fan as defined in claim 7, further including said powering means being comprised of an electrical dry-cell battery.

* * * * *